United States Patent [19]

Fischer

[11] 4,404,909

[45] * Sep. 20, 1983

[54] INK SUPPLY ARRANGEMENT FOR AN OFFSET PRINTING MACHINE

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[ * ] Notice: The portion of the term of this patent subsequent to Mar. 16, 1999, has been disclaimed.

[21] Appl. No.: 362,623

[22] Filed: Mar. 29, 1982

Related U.S. Application Data

[63] Continuation of Ser. No. 186,533, Sep. 12, 1980, abandoned.

[30] Foreign Application Priority Data

Oct. 23, 1979 [DE] Fed. Rep. of Germany ..... 2942734

[51] Int. Cl.[3] ..... B41F 31/14; B41F 31/26

[52] U.S. Cl. ..... 101/350; 101/207

[58] Field of Search ..... 101/147, 148, 349–352, 101/363, 364, 340, 341, 344, 345, 347, 355, 356, 357, 360, 361, 204, 205, 206, 207, 208–210, 342, 343, 346, 348, 353, 354, 358, 359; 118/262, 258

[56] References Cited

U.S. PATENT DOCUMENTS

| | | | |
|---|---|---|---|
| 2,436,455 | 2/1948 | Seybold | 101/350 |
| 2,821,133 | 1/1958 | Brodie | 101/350 X |
| 3,106,154 | 10/1963 | Saul | 101/350 X |
| 3,150,589 | 9/1964 | Senogles | 101/350 |
| 3,261,287 | 7/1966 | Brodie | 101/148 |
| 4,129,077 | 12/1978 | Fischer | 101/350 |
| 4,319,525 | 3/1982 | Fischer | 101/350 |
| 4,350,094 | 9/1982 | Fischer . | |

*Primary Examiner*—J. Reed Fisher

*Attorney, Agent, or Firm*—Frishauf, Holtz, Goodman, Woodward

[57] ABSTRACT

To permit efficient re-transport of ink-water emulsion from a plate cylinder to the ink trough, and permit formation of ink accumulation and ink pools, particularly when mixed with wetting water, a cage-like holder is provided in which a plurality of roller elements, for example balls or elongated pins or cylindrical rollers, all with ink-accepting surfaces, are in surface-frictional engagement with a pair of rollers which project from the cage-like container. The rollers projecting from the container are in contact, respectively, with the ink duct roller receiving ink from an ink trough and another roller of the ink distribution train of the ink distribution system of the printing machine, preferably with the transfer roller receiving ink from the duct roller, to provide a bypass and re-transport path for water-ink emulsion, particularly when printing on paper or of a subject matter which covers less than the width of the plate cylinder so that ink is not removed by the printing operation throughout the width of the rollers.

18 Claims, 2 Drawing Figures

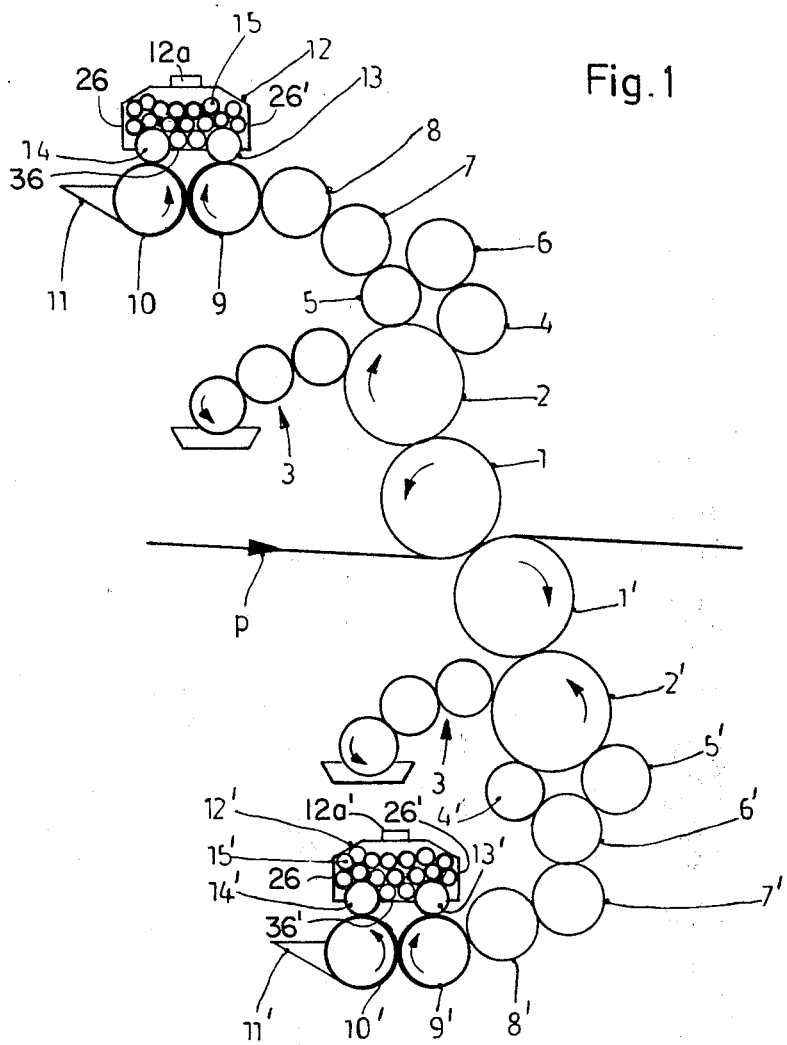
Fig. 1
Fig. 2
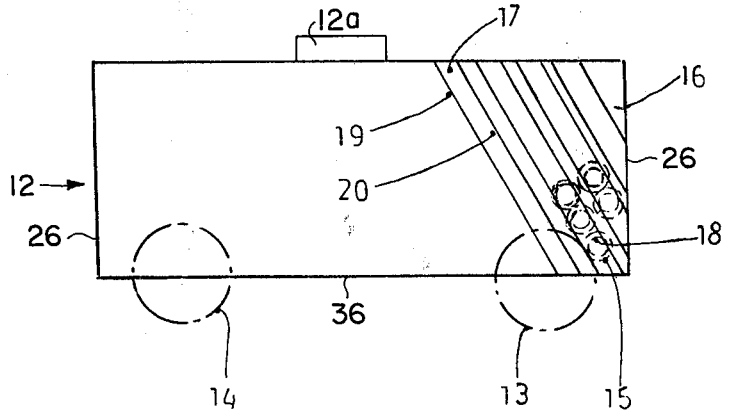

INK SUPPLY ARRANGEMENT FOR AN OFFSET PRINTING MACHINE

This is a continuation of application Ser. No. 186,533, now abandoned, filed Sept. 12, 1980.

The present invention relates to offset printing machines, and more particularly to the inking system therefor, and especially to an inking system which has a duct roller receiving ink from an ink trough and rotating at a slow speed, whereas subsequent ink distribution rollers operate at high speed, and include, for example, axially oscillating milling rollers, ink transfer rollers, and forme rollers; and which further includes an arrangement to transport ink or a water-ink emulsion back in the direction towards the ink duct roller.

Background and Prior Art

It is known that when offset printing machines are used to print only half the width of the printing cylinders, or on paper which is not well ink-absorbent, for example on coated on highly calendared paper, or foil-coated paper, the ends of the ink fountain system rollers will have a collection of water-ink mixture accumulate thereon. This mixture of water and ink, under some conditions, will spray off, and lead to contamination and soiling not only of the machine and the surrounding area, but also of printed subject matter. In these ranges, the effect of an oscillating milling roller frequently will no longer be felt, since this mixture has a low friction or splitting capability, and thus can no longer be pulled into the range in which printing is to be effected by the oscillating rollers. Lithographic offset printing, by definition of the process, requires a certain proportion of water in the system. Water is simultaneously removed from the ink by the printing process and by the transfer to the rubber blanket. Thus, supply of a mixture including water to the ink trough usually does not cause damage, particularly since in the ink duct or ink trough a finely dispersed mixture of the ink is effected by a stirrer, or similar agitating apparatus. The stirring or agitation of the ink causes mixing of the mixture returned to the ink trough with ink which is low in, or free from water so that the overall mixture will have only a very small percentage of damping water therein. Return of the damping water to the ink trough or ink supply usually is not damaging, and not sufficient to cause excessive accumulation of water within the ink supply.

It has been proposed—see German Published Patent Application DE-AS 27 03 425—to return a water-ink mixture to the ink trough by means of a return or feedback roller. This feedback roller cooperates directly with an ink duct roller. A blade, in the form of a doctor blade, is located above the ink duct roller. This arrangement can be used both with film ink supply system as well as with lifter or ductor roller supply systems. It has been found that the intermittent connection of the feedback or return roller on the ink transfer roller or on the ink duct roller or on a doctor blade cooperating therewith results in intermittent removal and re-cycling of excess emulsion due to the different circumferential speed between the duct roller and the ink transfer roller providing ink to the ink distribution roller system.

The Invention

It is an object to provide an ink-water mixture return supply system which permits continuous recycling of water-ink emulsion or mixture.

Briefly, the ink duct roller is in ink transferring relation with a roller train having an ink transfer roller and a plurality of ink distribution rollers receiving ink from the transfer roller. The ink duct roller operates at a circumferential speed which is low with respect to the circumferential speed of the distribution and transfer rollers, which form an ink transfer train. In accordance with the invention, this system is combined with a cage-holder from which two rollers project, and which retains therein a plurality of roller elements, for example in form of cylindrical pins, rollers, or balls, guided for floating, centerless rotation within the cage. The rollers projecting from the cage are in circumferential frictional engagement, respectively, with the duct roller operating at a low speed and one of the rollers of the ink roller train, preferably the transfer roller, operating at a high speed.

The system has the advantage that the roller elements within the cage are in continuous contact both with the ink duct roller as well as with one of the subsequent rollers of the ink transfer and ink distribution train, for example the ink transfer roller, or one of the oscillating or milling rollers. Continuous and uniform re-transport and recycling of water-ink mixture, typically a water-ink emulsion, will result. The feedback transport arrangement can be used both with film ink supply systems, as well as with oscillating ink systems.

The combination of the roller trains with the cage-like holder within which the roller elements are retained permits bridging of speed differences of the co-operating rollers. The cage-like system in combination with the drive rollers which project therefrom can be applied between the duct roller and—looked at in the direction of ink transport—the next subsequent transfer roller in the ink distribution roller train. The ink feedback roller device permits re-transfer of excess ink to the ink trough even before the ink becomes gummy, or otherwise difficult to handle or useless. The arrangement has the commercial advantage that the roller elements within the cage-like holders require neither bearings nor separate drives. The cage-like holders, with the rollers and roller elements therein, can be placed on the respective rollers, merely loosely held in position, and receiving drive by frictional engagement with the rollers on which it is placed, and on which it can rest by its own weight.

DRAWINGS

FIG. 1 is a highly schematic side view of a film inking system using the water-ink re-transport feedback system; and FIG. 2 is a highly schematic side view, partly in phantom, of the holder arrangement and showing centerless guiding of cylindrical rollers therein.

FIG. 1 is a schematic side view of a rotary offset printing maching having two superposed printing systems. Since the systems, as shown, are identical, the respective elements of the upper and lower system have been given the same reference numerals, with the lower system with prime notation; only the upper system will be discussed in detail.

A paper web P is passed between two blanket cylinders 1, 1', moving in the direction of the arrow from left to right. The blanket cylinders 1, 1' are in contact with plate cylinders 2, 2'. Plate cylinder 2 receives damping liquid, typically water, from a damping fountain system 3. Looked at in the direction of the plate cylinder, two forme rollers 4, 5 are located in contact with the plate cylinder, which, in turn, receive ink from an oscillating milling roller 6. The forme rollers 4, 5 receive ink from ink distribution rollers 7, 8 of the ink roller train.

An ink transfer roller 9, forming part of the ink roller train, is in ink transferring relationship to the ink distribution roller 8. The transfer roller 9 is inked by an ink duct roller 10 which is located directly in ink transferring relationship to a trough 11.

Ink transport, thus, is from the duct roller 10 to the transfer roller 9, the distribution rollers 8, 7 and forme roller 5 to the plate cylinder 2. The distribution roller 7 may, if desired, be axially oscillating. In parallel to the inking of the plate cylinder, forme roller 5 also supplies ink to the plate cylinder via the axially oscillating milling roller 6 which is in surface contact with forme roller 5 and forme roller 4, and operating at the circumferential speed of the forme rollers 4, 5.

If it is desired to print narrow webs on rotary offset printing machines, or if the formats are not well suited to the width of the machine in sheet offset printing machines, it is possible that the ink distribution and the ink flow is interfered with, so that ink accumulation or ink pools will result. Axially oscillating rollers and milling rollers usually are not capable of further transporting such retarded or stationary ink since milling of the ink becomes impossible due to an offset similar to aquaplaning. The ink which is not utilized will build up on the respective rollers and, on the plate, the result will be streaking and ink distribution which is beyond control of the printer.

In accordance with the present invention, one or more ink return transport devices 12 are placed in the ink train in order to prevent accumulation of ink or ink pools, and to remove water-ink emulsion from the ink train. The ink transport devices 12 are located between the ink duct roller 10 and, preferably, the ink transfer roller 9. These ink transport devices 12 thus form a path parallel to the rollers 10, 9.

The ink return device 12 is formed by a cage-like container within which a large number of rolling elements, for example in the form of balls, pins, rollers, or other cylindrical elements, are retained. The rolling elements are located next to each other and on top of each other, preferably in several layers, without specific bearings, to be freely floating and in centerless mutual engagement with adjacent roller elements. They are so positioned within the cage-like container or holder 12 that they are in mutual circumferential frictional contact and drive each other by mutual friction. These roller elements 13, 14, which may have a fixed axial position within the holder 12, preferably have a larger diameter than the roller elements 15, and extend from the bottom wall 36 of the cage-like holder 12. The roller elements 15 may be balls; preferably, however, they are pin-type or extended cylindrical rollers, located with their axes of rotation parallel to each other and to the remaining rollers of the ink train. The surfaces of the respective roller elements 15 and of rollers 13, 14 are ink-accepting. Cages 12, 12' have side walls 16, 16', end walls 26, 26', and bottom walls 36, 36', each. They retain the roller elements in several layers. The cage-like containers 12, 12' are placed in position in the printing machine and located therein by suitable positioning holders **12*a*, 12*a'***.

Operation: Excess ink which may collect on the ink transfer roller 9, or water-ink emulsion, is transferred to the roller 13 within the cage-like holder 12. Roller 13 is driven by friction from roller 9 which, preferably, is positively driven. The rather sticky ink carriers roller 13 along. Roller 13 transfers the ink and ink-water mixture to the respective roller elements 15 within cage 12. The roller elements 15, likewise, will start to rotate by frictional engagement, due to their ink coating, with the roller 13 which, in turn, is driven by the transfer roller 9. The ink-water mixture eventually will reach the roller 14 which is in engagement with the duct roller 10. Duct roller 10 is driven at a substantially lower circumferential speed than the transfer roller 9. To accomodate the speed difference, the rollers 9, 10 are spaced by a narrow gap—as well known—which is small to provide for transfer of an ink film from roller 10 to roller 9, so that the inker forms a film ink system. After the surfaces of the respective roller elements 15 and of rollers 13, 14 are coated with ink, that is, after the rollers within the cage 12 all have received ink or ink-water emulsion, back-transport of ink-water emulsion and ink, respectively, from roller 9 to duct roller 10, and hence to the ink trough 11 will occur.

The rollers 13, 14 and the roller elements 15 within cage 12 need not be driven. Especially roller elements 15 need not have any specific bearings, and can be located within the holder 12 above each other and next to each other. They are driven due to their own weight and by surface friction. The roller elements 15 may be balls; they may, however, also be elongated cylindrical elements and, for some applications, it may be desirable to guide the roller elements in the side walls 16 of the cage 12. If this is desired, the roller elements 15 have extended axial pins or stubs 18 formed at their ends which are loosely guided in guide tracks or grooves 17 formed in the side walls 16 of the cage. The tracks 17 are defined by parallel ribs 19, 20 projecting inwardly from the sidewall 16 of the cage 12. The ribs 19, 20 provide for parallel guidance of elongated cylindrical roller elements 15 in the side walls 16. The roller elements are placed above each other in the slightly cantered or inclined guide tracks or grooves 17, and rest on each other by their weight. Holder 12, with the rollers 13, 14 therein and the roller elements 15 likewise can be seated on the duct roller 10 and the transfer roller 9 by its own weight.

It is not necessary, but frequently desirable, to provide an even number of roller elements 15 within the cage 12, at least in the position between the rollers 13, 14. Placing an even number of roller elements 15 between the rollers 13, 14 prevents application of torques acting in different direction, due to mutually different directions of rotation, which may cause stoppage of one or both of the rollers. Danger of mutually cancelling transfer torques is low if the speed differences between the circumferential speed of the duct roller 10 and the transfer roller 9 is comparatively high.

I claim:

1. In an offset printing machine having an inking system including an ink trough (11);

an ink duct roller (10) receiving ink from the ink trough (11);

a transfer roller (9) receiving ink from the ink duct roller (10) and positioned in ink film transferring relation to the ink duct roller;

and a plurality of ink distribution rollers (4-8) receiving ink from the transfer roller (9), said ink transfer roller (9) and the ink distribution rollers (4-8) forming an ink roller train, in which the ink duct roller (10) is operating at a circumferential speed which is low with respect to the circumferential speed of the ink transfer roller (9) and the ink distribution rollers (4-8);

apparatus preventing accumulation of ink or ink pools, and to remove water-ink emulsion from the ink train, comprising a cage-like holder (12) having confining end walls (26), side walls (16) and a closed bottom wall (36);

first and second ink transferring rollers (13, 14) having an ink accepting surface projecting from the cage-like holder;

and a plurality of loose roller elements (15) freely, centerless floatingly located in the cage-like holder for centerless self-positioned rolling movement between the confining walls and the bottom wall of the cage, some of the roller elements being in surface engagement with said ink transferring rollers (13, 14) and some of the roller elements being in surface engagement with each other to increase the surface area of ink being transported in the ink train, the plurality of roller elements being of such number that the distance between the ink transferring rollers (13, 14) within the cage-like holder (12) is spanned by at least some of the roller elements, and which will assume positions between the ink transferring rollers, the plurality of roller elements (15) being rotated by surface frictional engagement with the ink transferring rollers (13, 14);

and wherein said cage-like holder (12) is positioned in said printing machine for engagement of one (14) of the ink transferring rollers with the ink duct roller (10) and for engagement of the other of the ink transferring rollers (13) with one (9) of the rollers of the roller train (4-8; 9) to place said ink transferring rollers (13, 14) and the roller elements (15) therein in an ink and water-ink transferring path between the ink duct roller (10) and the ink transfer roller (9) which is in parallel to the path of ink from the ink duct roller (10) to the said one roller (9) of the roller train (4-8; 9).

2. Apparatus according to claim 1, wherein said second ink transferring roller (13) is in circumferential frictional engagement with the transfer roller (9) of the ink roller train.

3. Apparatus according to claim 1, wherein the first and second ink transferring rollers (13, 14) have a larger diameter than the roller elements (15) within said cage-like holder, the projecting circumferential portions of said first and second ink transferring rollers being in engagement, respectively, with the duct roller (10) and said one of the rollers (9) of the roller train.

4. Apparatus according to claim 3, wherein an even number of roller elements (15) is located between said first and second ink transferring rollers.

5. Apparatus according to claim 3, wherein the ink trough (11), the ink duct roller (10) and the transfer roller (9) form a film ink system.

6. Apparatus according to claim 1, wherein an even number of roller elements (15) is located between said first and second ink transferring rollers.

7. Apparatus according to claim 1, wherein the ink trough (11), the ink duct roller (10) and the transfer roller (9) form a film ink system.

8. Apparatus according to claim 1, wherein said plurality of roller elements (15) is of such number that several layers of roller elements are retained within the cage-like holder (12).

9. Apparatus according to claim 1, wherein said roller elements comprise balls.

10. Apparatus according to claim 1, wherein said roller elements comprise elongated cylindrical rollers.

11. In an offset printing machine having an inking system including an ink trough (11);

an ink duct roller (10) receiving ink from the ink trough (11);

a transfer roller (9) receiving ink from the ink duct roller (10) and positioned in ink film transferring relation to the ink duct roller;

and a plurality of ink distribution rollers (4-8) receiving ink from the transfer roller (9), said ink transfer roller (9) and the ink distribution rollers (4-8) forming an ink roller train, in which the ink duct roller (10) is operating at a circumferential speed which is low with respect to the circumferential speed of the ink transfer roller (9) and the ink distribution rollers (4-8);

apparatus preventing accumulation of ink or ink pools, and to remove water-ink emulsion from the ink train, comprising a cage-like holder (12) having confining end walls (26), side walls (16) and a closed bottom wall (36);

first and second ink transferring rollers (13, 14) having an ink accepting surface projecting from the cage-like holder;

a plurality of elongated cylindrical roller elements (15) located in the cage-like holder and of such number that several layers of said roller elements are retained within the cage-like holder, some of the roller elements being in surface engagement with said ink transferring rollers (13, 14) and some of the roller elements (15) being in surface engagement with each other to increase the surface area of ink being transported in the ink train;

guide tracks (17) formed in the side walls (16) of the cage-like holder, and axial stub pins (18) projecting laterally from the roller elements and being guided in said guide tracks for floating positioning of said roller elements in axially parallel relationship with respect to each other and with respect to the two ink transferring rollers (13, 14), the plurality of roller elements being of such number that the distance between the ink transferring rollers (13, 14) within the cage-like holder (12) is spanned by at least some of the roller elements, and which will assume positions between the ink transferring rollers, the plurality of roller elements being rotated by surface frictional engagement with the ink transferring rollers (13, 14);

and wherein said cage-like holder (12) is positioned in said printing machine for engagement of one (14) of the ink transferring rollers with the ink duct roller (10) and for engagement of the other of the ink transferring rollers (13) with one (9) of the rollers of the roller train (4-8; 9) to place said ink transferring rollers (13, 14) and the roller elements (15) therein in an ink and water-ink transferring path between the ink duct roller (10) and the ink transfer roller (9) which is in parallel to the path of ink from the ink duct roller (10) to the said one roller (9) of the roller train (4-8; 9).

12. Arrangement according to claim 11, wherein the guide tracks (17) are inclined with respect to a plane connecting the axes of rotation of said first and second ink transferring rollers (14, 13);

and said first and second rolles have a circumference which is larger than the circumference of said cylindrical roller elements (15) and project partially beyond the cage-like holder (9).

13. Arrangement according to claim 12, wherein an even number of roller elements (15) is located between said first and second ink transferring rollers.

14. Arrangement according to claim 13, wherein the ink trough (11), the ink duct roller (10) and the transfer roller (9) form a film ink system.

15. Arrangement according to claim 11, wherein said second ink transferring roller (13) is in circumferential frictional engagement with the transfer roller (9) of the ink roller train.

16. Arrangement according to claim 11, wherein the first and second ink transferring rollers (14, 13) have a larger diameter than the roller elements (15) within said cage-like holder, the projecting circumferential portions of said first and second ink transferring rollers being in engagement, respectively, with the duct roller (10) and said one of the rollers (9) of the roller train.

17. Arrangement according to claim 11, wherein an even number of roller elements (15) is located between said first and second ink transferring rollers.

18. Arrangement according to claim 11, wherein the ink trough (11), the ink duct roller (10) and the transfer roller (9) form a film ink system.

* * * * *